US006062232A

United States Patent [19]

Johnson

[11] Patent Number: 6,062,232

[45] Date of Patent: May 16, 2000

[54] HAIR ACCESSORY HOLDER FOR UPRIGHT ATTACHMENT

[76] Inventor: Debra Lea Johnson, 1865 Whalebone Dr., Kalispell, Mont. 59901

[21] Appl. No.: 09/329,351

[22] Filed: Jun. 10, 1999

[51] Int. Cl.[7] ..... A45D 8/36

[52] U.S. Cl. ..... 132/273; 132/212

[58] Field of Search ..... 132/212, 273, 132/275, 276, 279; 446/73, 268, 369, 370, 372; 63/3, 12, 15.65; 70/456 R, 459, 457, 458; D11/2, 30

[56] References Cited

U.S. PATENT DOCUMENTS

| | | | |
|---|---|---|---|
| 2,805,566 | 9/1957 | Martinuzzi | 70/456 R |
| 3,804,307 | 4/1974 | Johnston | 63/3 |
| 3,930,331 | 1/1976 | Simeone | 446/369 |
| 5,174,139 | 12/1992 | Huang | 70/456 R |
| 5,520,036 | 5/1996 | Collier | 70/456 R |
| 5,626,503 | 5/1997 | Heftel et al. | 132/275 |

*Primary Examiner*—John J. Wilson
*Assistant Examiner*—Pedro Philogene
*Attorney, Agent, or Firm*—John P. Halvonik

[57] ABSTRACT

A plurality of flexible and detachable bands in the center of the accessory are used to hold various hair accessories. There is at least one top loop in connection with the pillow that allows for attaching the apparatus to a door knob or the like in order to hang the device from a door. Bottom loops are of dissimilar length so as to allow for holding larger hair bands on the large strand and barrettes and smaller bands on the shorter strand.

3 Claims, 1 Drawing Sheet

HAIR ACCESSORY HOLDER FOR UPRIGHT ATTACHMENT

FIELD AND BACKGROUND OF THE INVENTION

The invention relates to the field of supports, and in this case, a support for securing a plurality of hair accessories, including barrettes, hair bands and clips to a door knob of similar place for hanging the device.

The devices comprises a series of fabric loops in connection with a softer fabric in the shape of a pillow that is in the center and in connection with all of the loops. Hair accessories, e.g. barrettes, clips and hair bands may be held on the pillow and the various sized loops so that they can be readily removed as needed and when not in use the hair accessories will store neatly and out the way.

One of the motivating reasons for the creation of the invention was to find a way to organize and keep straight such hair accessories while still keeping them in a manner that can be readily accessed. Keeping that in mind, one of the advantages of the invention is that it can be hung on a doorknob or a similar out of the way place for safe keeping the hair accessories and to allow them to be accessed as needed.

Hair accessories are, of course, used for grooming the hair and giving it a more generally attractive appearance. As such, it should come as no surprise that fashion conscious females are the largest purchasers of such accessories and they typically have longer hair and maybe somewhat more trendy and fashion conscious about their hair. Thus it is typically that many females (and perhaps some males) will come to acquire a large menagerie of hair accessories to fit many different occasions.

Such accessories are, of course, in keeping with the latest in fashion trends and general stylishness as applied to hair styles. With that in mind, the device described herein is somewhat fashionable as it generally provides a fabric type of device that can be manufactured in many different styles and colors. The device should be somewhat stylish when consideration is given to the final purchaser who is likely to be a fashion conscious person.

BACKGROUND AND PRIOR ART

While there are devices for holding hair accessories, there are no devices known in the prior art that are of the same construction as the applicant's that allows the hair accessory support to be attached to a door knob via a loop or strand. Use of such a doorknob allows the device to be hung in a vertical manner in a convenient place where the device and the hair accessories can be easily accessed. Use of the fabric portions that comprise the device result in an accessory holder that is, itself, stylish and fashionable.

SUMMARY OF THE INVENTION

The invention comprises a soft pillow member in the center that is in connection with a plurality of flexible bands that are used to hold various hair accessories. The bands are designed with one end that is detachable (e.g. by VELCRO attachment) from the main pillow so that head bands and the like can be placed over the strand and then secured by reattaching the strand to the pillow.

There is at least one top loop that is also in connection with the pillow that allows for attaching the apparatus to a door knob or the like in order to hang the device from a door. Bottom loops are of dissimilar length so as to allow for holding larger hair bands on the large strand and barrettes and smaller bands on the shorter strand.

It is an object of the invention to provide a hair accessory holder for barrettes, hair clips hair bands and the like that can readily store the accessories in an out of the way place when they are not in use and can provide easy access when they are needed to be used.

It is another object to provide a hair accessory storage device that can organize such accessories in a systematic and sensible manner so that one can readily locate different hair accessories based on the function of each, so that for example all the barrettes are on the same strand.

Yet another object of the invention is to provide a hair accessory device that can securely hold barrettes upon a vertical surface such as that of a door and in doing so will securely hold the barrettes and such to the device in such a manner that they will not be knocked off of the device when the door is closed or otherwise moved.

Another object is to provide a hair accessory holder that can be made in stylish and attractive fabrics and colors in keeping with the general aesthetically pleasing nature of hair accessories and other fashion adornments.

Another object is to provide a hair accessory holder that can be easily moved into a convenient, out of the way place when not in use and such function is enhanced by the ability of the device to be hung on doorknobs and the like.

Other objects will be apparent to those skilled in the art once the invention is shown and described.

DESCRIPTION OF THE PREFERRED EMBODIMENT

Figure 1:
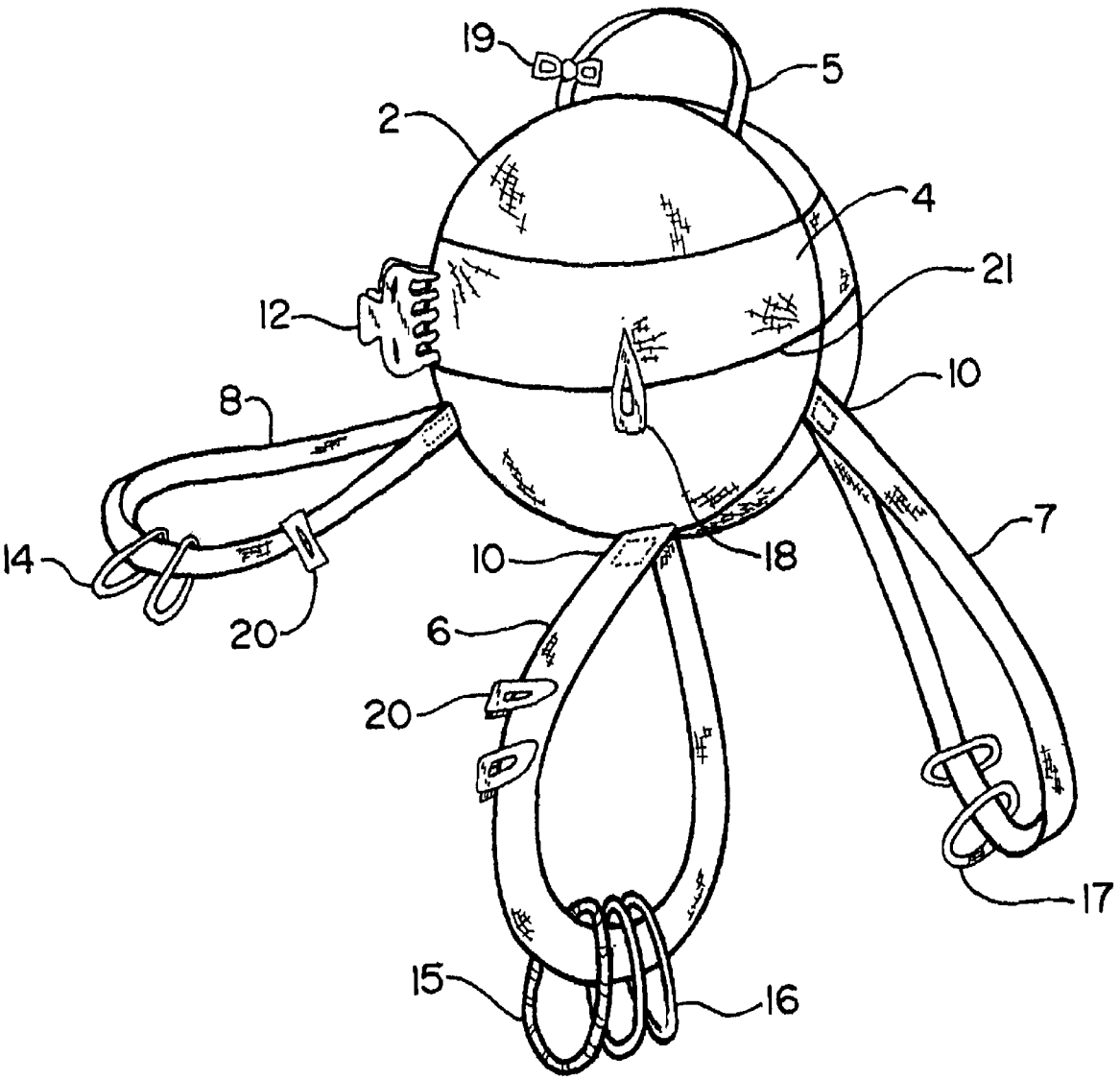
FIG. 1 overall view of apparatus in use.

In constructing the device, the central "pillow" 2 is more or less of a filled cushion type construction and is covered with material that will complement the other colors and materials of the rest of the device. Such pillow is the central part of the device and a series of "arms" or strands (5, 6, 7 and 8) will emanate from there. The pillow is preferably equipped with at least one "band" 4 of material, such as cloth, that is stitched to the pillow at two ends and will encircle the pillow at least partially.

Thus, the band will go around the equator of the pillow and will only be connected at the two ends so that the band can hold smaller clips 18 that are clipped upon the upper and lower edges 21 of the band as it exists on the pillow. "Claw clamps"12 are somewhat larger than the clips and can also be attached to the pillow. In this case by simply opening the jaws of the clamp and attaching to the pillow. Smaller accessories, such as ribbon barrettes 19 and the like can be attached by clipping them over the upper strand 5 or by any other method that seems appropriate in keeping with the organziational function of the invention.

There would preferably be at least four strands in connection with the central pillow. There is one upper strand 5 that is relatively large and of circular shape so that is ideally sized and shaped for hanging over a doorknob. This strand should be more or less permanently attached to the central pillow and such permanent attachment can be stitching both ends of the strand to the pillow or else making the strand an integral portion of the pillow material.

In any case, both ends of this strand will be more or less permanently connected to the central pillow and thus this upper part of the device can be draped over a door knob or hung from a hanger or similar device in order to hang the device and the accessories in a vertical position on the door or perhaps, a wall. The two ends of the upper strand should be attached to near the top of the central pillow and small space away from each other (e.g. about 2–3" so that this strand can assume a more circular shape and so drape it over the knob. The strand should be about 10–12" in length and this length is chosen so that this strand can easily be draped over the knob of a door.

As stated, the use of the door knob in connection with the device will allow the device to be held in a conveniently accessed and at the same time, out of the way place.

There are preferably three other strands that are in connection with the pillow and hang down from the pillow. As such they are referred to as the lower strands. Each of the lower strands should have one end in more or less permanent connection to the pillow just like both ends of the upper strand and of course this connection can be by way of stitching or the like.

At the other end of the strand should be a VELCRO 10 (trademark name for mating portions hook and loop material) portion of material that is designed to be mated with a corresponding portion of VELCRO material in connection with the central pillow.

In this manner, each of the lower strands (5, 6, and 7) can be opened and closed to form a loop so that hair accessories can be attached to the strand by opening the loop, and adding the accessory and then closing the loop by attaching the a VELCRO portions to one another. For example, to attach a barrette 20, the barrette should first be opened and, whatever strand it is desired to attach it to, that strand should also be opened (by separating the two VELCRO portions from one another). Note that 20 is a larger type of barrette, typically made of leather and can find a home on the middle strand 6 so as to keep it sorted from the smaller metal barrette on the other strand.

The barrette would then be fed onto the strand and the barrette then closed upon the strand. The strand can then, in turn, be closed by mating the VECLRO portion at the free end of the strand with that VELCRO portion on the central pillow. In the case of hair bands (14, 15, 16 and 17) and the like, the strand is again opened and the band fed onto the strand and the strand then closed again.

It is preferred that the middle one 6 of the lower strands be of considerably longer length than the other two and so will hang down lower than the other two and allow for larger type of hair accessories to be hung on this strand. This strand will probably end up holding such accessories as head bands 16 (which are large enough to encircle the head); and larger type hair bands 15, often referred to as "scrunchies". 17 is another form of hair band somewhat thicker and more plush than 16.

As the middle strand is longer than the other two, those accessories on this strand will necessarily hang down lower than accessories on the other strands and so the user will readily see the head bands and hair bands as they hang down from the middle and are lower than the other accessories. This strand would preferably be about 14–18" in length.

The two other lower strands should be of dissimilar length than the middle lower strand so that they can be used to hold different types of hair accessories. Typically all of the lower strands will hold bands e.g. hair bands and barrettes. Different types of barrettes and hair bands can be held on the different strands so that they can be readily found when they are needed. In the case of the other two lower strands, it is preferred that they be about 10–12" in length from one end of the strand to the other. Again these strands should be permanently attached to the pillow at one end and the other end has VELCRO to mate with portions on the central pillow.

The sizes and widths of the stands should be chosen with some consideration of the final use they will be put to. As at least one of the two lower strands will be holding barrettes, the width of that strand should be chosen with that mind. As such, the lower strands should be about an inch or somewhat less in width. Such width is chosen so that the barrette will be able to fit across the width of the strand. Were the strand to be significantly wider than that, it would prevent the clip or barrette from being slid upon the strand.

The invention can be made in a vast arrays of colors and fabrics styles in order to be as aesthetically pleasing as possible. It is preferred that both the strands and the pillow be made of a cloth construction. It is preferred that the cloth should not be of a stretchable variety but a more traditional non stretchable variety. It is also preferred that the cloth be of a machine washable variety.

I claim:

1. An apparatus for securing hair accessories, said apparatus comprising a central soft pillow of cloth material and having an upper strand and at least three lower strands in connection with said pillow, said upper strand having two ends, each of said ends stitched to said pillow, each of said lower strands having two ends, one end in connection with said pillow and the other of said ends having complimentary hook and loop portions of material; said pillow having a complimentary hook and loop portion of material that is complimentary to said complimentary hook and loop portion that is in connection with said ends of said lower strands, at least one of said lower strands being a longer strand that is longer than the other two lower strands, so that said longer strand will hang down from said pillow for a longer distance than said the other two lower strands when said lower strands are mated to said pillow by means of said complimentary hook and loop portions.

2. The apparatus of claim 1, wherein said lower most strand is about 14"–18" in length and said other two lower strands are about 10–12" in length.

3. The apparatus of claim 2 wherein said pillow has in connection a band of material around said central soft pillow, said band having a pair of ends that are in connection with said pillow; said band having sides that are not in connection with said pillow so that the hair accessories may be attached over said ends of said band.

* * * * *